United States Patent [19]

Focke

[11] Patent Number: 4,953,711

[45] Date of Patent: Sep. 4, 1990

[54] METHOD AND DEVICE FOR ELIMINATING IMPERFECT CIGARETTES IN CONNECTION WITH A CIGARETTE PACKAGING MACHINE

[75] Inventor: Heinz Focke, Verden, Fed. Rep. of Germany

[73] Assignee: Focke & Co. (GmbH & Co.), Verden, Fed. Rep. of Germany

[21] Appl. No.: 330,922

[22] Filed: Mar. 24, 1989

Related U.S. Application Data

[63] Continuation of Ser. No. 60,887, Jun. 12, 1987, abandoned.

[30] Foreign Application Priority Data

Jun. 20, 1986 [DE] Fed. Rep. of Germany ..... 3620735

[51] Int. Cl.[5] ..... B07C 5/00

[52] U.S. Cl. ..... 209/535; 53/151

[58] Field of Search ..... 209/535, 536, 539, 542, 209/644, 911; 53/54, 148, 151; 131/282, 283, 905, 907

[56] References Cited

U.S. PATENT DOCUMENTS

| | | | |
|---|---|---|---|
| 4,174,780 | 11/1979 | Farrar et al. | 209/536 |
| 4,376,484 | 3/1985 | Seragnoll | 209/535 |
| 4,487,001 | 12/1984 | Tolasch | 53/151 |
| 4,496,055 | 1/1985 | Green et al. | 209/535 |
| 4,574,958 | 3/1986 | Manservisi | 209/535 |
| 4,646,938 | 3/1987 | Focke | 53/151 |
| 4,648,232 | 3/1987 | Brinker et al. | 209/535 |
| 4,667,831 | 5/1987 | Mattei et al. | 209/535 |
| 4,856,538 | 8/1989 | Focke et al. | 209/536 X |

FOREIGN PATENT DOCUMENTS 2006425 2/1969 Fed. Rep. of Germany .

*Primary Examiner*—Donald T. Hajec

*Attorney, Agent, or Firm*—Sughrue, Mion, Zinn, Macpeak & Seas

[57] ABSTRACT

To examine cigarettes (11) prior to packaging same, a testing unit (17) is disposed in a cigarette magazine (12) above magazine chutes (13). The testing unit (17) is provided with test chutes (28) for the accommodation of a vertical test line (26) of cigarettes. Guide and support elements (36, 37) are disposed on the underside and, by means of relative displacements, they produce a stoppage phase of the cigarettes in the test chutes (28) and effect delivery of the tested cigarettes.

5 Claims, 6 Drawing Sheets

METHOD AND DEVICE FOR ELIMINATING IMPERFECT CIGARETTES IN CONNECTION WITH A CIGARETTE PACKAGING MACHINE

This is a continuation of application Ser. No. 07/060,887 filed June 12, 1987, now abandoned.

DESCRIPTION

The invention relates to a method of determining and eliminating imperfect cigarettes (defective cigarettes) in the region of a cigarette magazine, the lower portion of which comprises (groups of) magazine chutes to form groups of cigarettes and to discharge same, the cigarettes passing through a testing zone (test chutes) above the magazine chutes in vertical lines and being individually examined in the testing zone, and defective cigarettes are eliminated. In addition, the invention relates to a device for determining and eliminating defective cigarettes.

It is necessary and usual practice to check cigarettes for their correct form prior to their being packaged. This examination of cigarettes is mainly effected after the groups of cigarettes have been formed, e.g. in the region of a cigarette turntable. However, it is also already basically known to check cigarettes in the region of the cigarette magazine and to eliminate any defective cigarettes here. The invention is concerned with examining cigarettes and eliminating defective cigarettes in the region of the cigarette magazine.

It is an object of the invention to effect examination of the cigarettes with greater efficiency, whilst at the same time ensuring that the fragile cigarettes are treated gently.

To achieve this object, the method according to the invention is characterised in that, in each test chute, a number of cigarettes, such number corresponding to the number of simultaneously tested cigarettes, are separated from the subsequent cigarettes, especially by means of transverse displacement, and in that these cigarettes—preferably after defective cigarettes have been previously eliminated—are then released downwardly.

Thereafter, the cigarettes inside the cigarette magazine are conducted into a testing unit comprising vertical test chutes and checked here for their correct form. Then—after any defective cigarettes have been eliminated—the tested cigarettes are released downwardly. Due to their own weight, they drop down onto a store of tested cigarettes above the magazine chutes. Meanwhile, the vertical lines of cigarettes in the test chutes are stopped. The examination is effected during delivery of the cigarettes already tested.

The device according to the invention is provided with a testing unit in the cigarette magazine at a distance above the magazine chutes. The testing unit substantially comprises vertical test chutes and cigarette testing means associated with the test chutes. A cigarette transfer means, which is effective for all of the test chutes, is disposed at the lower (outlet) end of the testing unit. The cigarette transfer means is displaceable, by means of transverse displacement, into various relative positions in relation to the test chutes. This arrangement permits transfer of the tested cigarettes to the lower portion of the cigarette magazine, while cigarettes disposed thereabove in the region of the test chutes are simultaneously examined during the stoppage period.

Additional features of the invention relate to the structural configuration of the cigarette magazine and to details of the testing unit.

One embodiment of the invention is explained more fully hereinafter with reference to the drawings.

Figure 1:
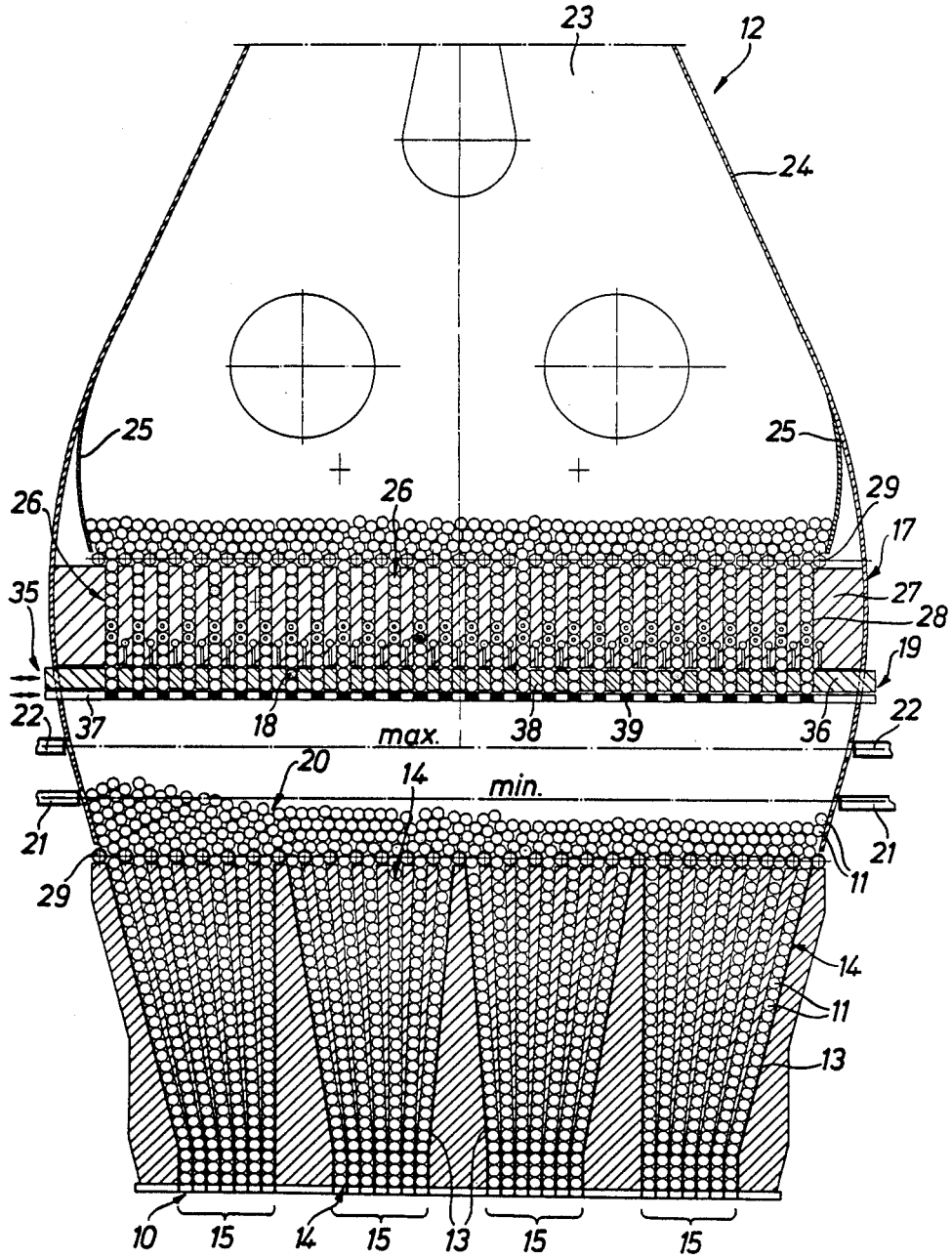
FIG. 1 is a vertical sectional view through the major portion of a cigarette magazine.

Prior to cigarette groups 10 being formed from a number of cigarettes 11, which number corresponds to the content of one cigarette packet, the cigarettes 11 are fed into a cigarette magazine 12. In its lower portion, the cigarette magazine 12 is provided with vertical magazine chutes, each chute serving to accommodate one vertical cigarette column 14. In each case, a plurality of magazine chutes 13, corresponding to the content of one cigarette packet, are combined to form chute groups 15. At the lower end, the cigarette groups 10 are discharged from the magazine chutes 13 in a conventional manner by suitable discharge means 16 and passed to the packaging operation.

In the present case, the cigarette magazine 12 is provided with a particular configuration, and its interior accommodates a testing unit 17 substantially at the halfway level, but in any event at a distance above the chute groups 15. The testing unit 17 temporarily accommodates the cigarettes 11, which flow from top to bottom inside the cigarette magazine 12 due to their own weight, and checks them for correct form (presence of tobacco, filter, etc.). Any imperfect cigarettes (defective cigarettes 18) are identified in the region of the testing unit 17 and eliminated here, so that tested, i.e. correct, cigarettes are exclusively supplied to the magazine chutes 13.

For the examination to be carried out, the cigarettes 11 are temporarily stopped in the region of the testing unit 17, with the result that the examination is effected when the cigarettes are in a rest phase. The defective cigarettes 18 are eliminated in the region of a delivery plane, namely by being discharged in an axial direction, i.e. in a direction parallel to the longitudinal dimension of a cigarette. The intact cigarettes are released downwardly and, due to their own weight, drop onto a chuteless cigarette store 20 formed above the magazine chutes 13. The level of the cigarette store 20 is checked, e.g. by means of light barriers 21 and 22, this check being constantly effected to ascertain the lower, minimum level of cigarettes and the upper, maximum level of cigarettes.

The cigarettes 11 are introduced into the cigarette magazine 12 via an upper inlet aperture 23. The cigarette magazine 12 comprises a housing 24 which has a substantially droplet-shaped configuration in the present case. The testing unit 17 is disposed in the portion of the housing having the greatest transverse dimension. Guide plates 25 are disposed on the inner surface of the housing 24 and lead to the testing unit 17 extending over the full width of the cigarette magazine 12.

The cigarettes 11, which flow through the testing unit 17 and are aligned in an axis-parallel manner, are split up into individual, vertical testing columns 26. The number of testing lines 26 corresponds substantially to the number of magazine chutes 13. For this purpose, vertical test chutes 28 are disposed inside a block 27 so as to be parallel to one another and with identical spacings between one another. Displaceable, especially rotatable, guide rods 29 are mounted on the upper inlet ends of the test chutes 28 and ensure that the cigarettes are positively and gently introduced into the test chutes 28.

Inside the test chutes 28, the test columns 26 of cigarettes are moved past testing means 30 mounted laterally on the housing 24, namely in lateral walls 31 and 32 of the housing 24, so that the testing means 30 act on the front ends of the cigarettes 11. The testing means 30 are preferably opto-electrical sensors and are connected to evaluating units 33. In the present, preferred embodiment, two testing means 30 are associated with each test column 26, one being disposed immediately above the other, so that two cigarettes 11 at a time, lying one above the other, are simultaneously examined, this operation being effected in a testing plane 34.

The lower portion of the testing unit 17 is in the form of a delivery and discharge means 35 for delivering and discharging the cigarettes after examination has been effected. The delivery and discharge means 35 ensures that the cigarettes 11 in the test columns 26 are correctly aligned with the testing means 30 in respect of height during the examination operation, i.e. during the temporary stoppage. In addition, tested and correct cigarettes are delivered to the cigarette store 20 whilst, substantially at the same time, a subsequent group of (two) cigarettes 11 is being examined.

For this purpose, the delivery and discharge means 35 comprises two guide and support means 36 and 37 which are displaceable in transverse planes relative to each other and relative to the remaining portion of the testing unit 17. The guide and support means 36 and 37 are cog-like plates and comprise cog webs 38 or support webs 39, respectively, which are associated with the individual test chutes 28. The guide and support means 36 and 37, or respectively their cog webs 38 and support webs 39, are displaceable in accordance with the directional arrows 40 and 41 illustrated in FIGS. 4, 5 and 6. The webs 38 and 39 have the same width as the dividing walls 42 which are provided between the test chutes 28. The cog webs 38 immediately below the dividing walls 42 have a structural height which corresponds to the height of the number of simultaneously tested cigarettes 11 per test column 26, i.e. the height of two cigarettes disposed one above the other in the present case. By comparison, the lower guide and support means 37 with the support webs 39 has a smaller structural height. Both guide and support means 36 and 37 extend laterally from the cigarette magazine 12 and are driven by suitable means, e.g. by pressure-medium cylinders.

Figure 4:
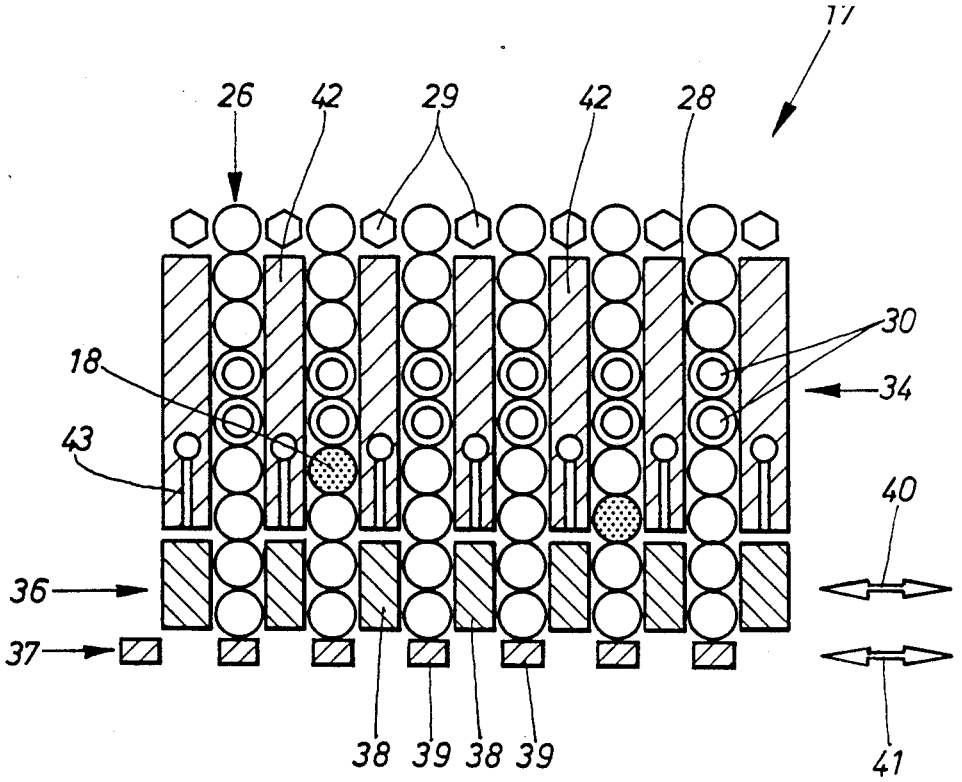
FIG. 4 is also an enlarged detail of the testing unit of the cigarette magazine in a first relative position.

The various positions and functions of the guide and support means 36 and 37 are best explained with reference to FIGS. 4 to 6. The cog webs 38, support webs 39 and dividing walls 42 all have the same horizontal spacing FIG. 4 illustrates an initial position before examination of the cigarettes commences. The cog webs 38 are aligned with the dividing walls 42, so that the test chutes 28 extend continuously to the support webs 39. The support webs 39 are displaced in an offset manner relative to the cog webs 38, and consequently they are disposed in the region of the test chutes 28, so that the cigarettes (test column 26) located therein rest on the support webs 39.

Figure 5:
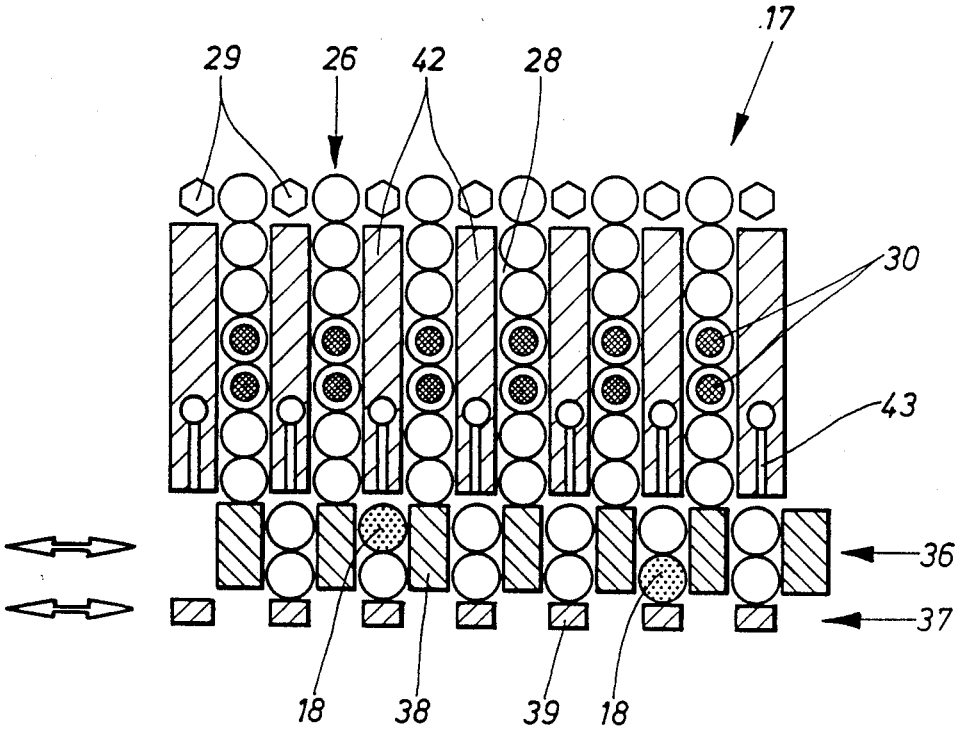
FIG. 5 illustrates the detail of FIG. 4 in a modified relative position, namely in the testing position.

For the examination to be carried out, the cog webs 38 are displaced to the right, by a distance equal to one-half the horizontal spacing, from the initial position shown in FIG. 4 into the test position shown in FIG. 5. The cog webs are now disposed in the (vertical) plane of the test chutes 28, so that the cigarettes disposed above the cog webs 38 are supported on the cog webs 38. The relative position is now so selected that the cigarettes in the testing plane 34 are accurately aligned with the testing meand 30. Simultaneously (position shown in FIG. 5), the support webs 39 are also displaced to the right by the same distance. They are now disposed below the dividing walls 42 and serve to support each pair of cigarettes disposed one above the other between adjacent cog webs 38. These already tested cigarettes, including any defective cigarettes 18, have been displaced with the cog webs 38 into the illustrated, offset test position. In the position shown in FIG. 5, the defective cigarettes 18 are conveyed from the cigarette magazine 12 in an axial direction, i.e. in a direction parallel to the longitudinal dimension of a cigarette.

Figure 6:
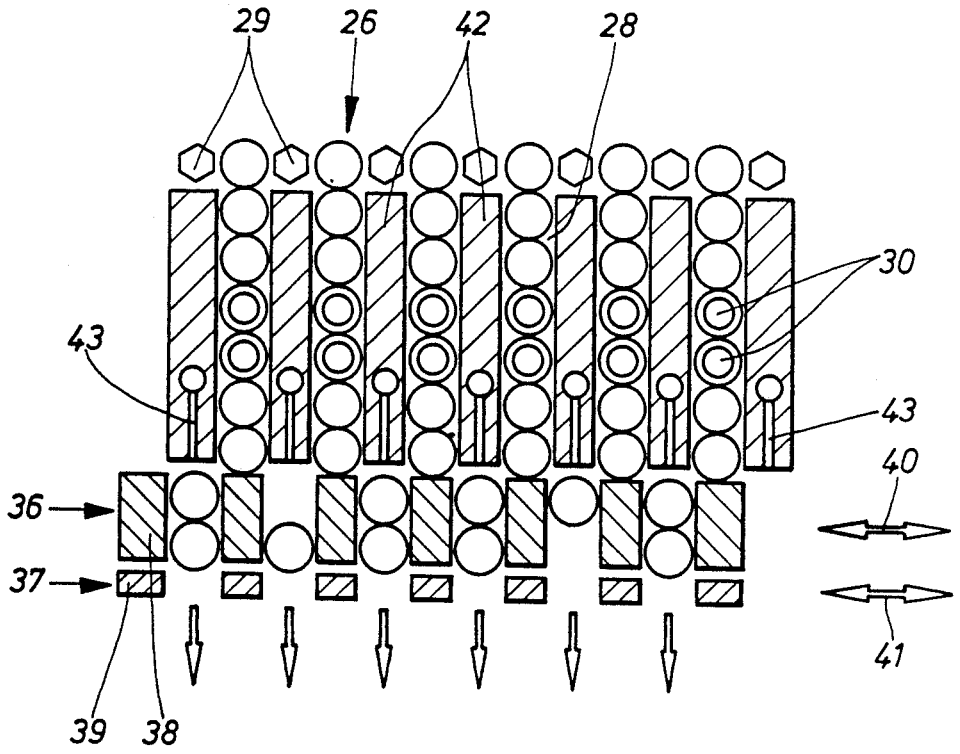
FIG. 6 illustrates another modified position of the detail shown in FIGS. 4 and 5, namely during the further transmission of tested cigarettes.

In the position shown in FIG. 6, the tested, intact cigarettes 11 are transferred to the cigarette store 20. For this purpose, the support webs 39 are transversely displaced, by a distance equal to one-half of the horizontal spacing, from the position shown in FIG. 5 (offset in relation to the cog webs 38) into the position shown in FIG. 6, thereby opening the partial chutes defined by the cog webs 38. The cigarettes disposed therein can now be ejected downwardly. In the illustrated embodiment, blast-nozzles 43 are disposed in the dividing walls 42 for this purpose. Since the cigarettes to be discharged are disposed in the region below the dividing walls 42, the blast-nozzles 43, or respectively the compressed-air delivered by the blast-nozzles 43, are immediately effective for discharging the cigarettes. As can be seen from FIG. 2, two blast-nozzles 43 are spaced apart from each other in each dividing wall 42. The blast-nozzles 43 are supplied by a common compressed-air connection 44.

After the tested cigarettes have been discharged as shown in FIG. 6, the guide and support means 36 with the cog webs 38 is moved back into the position shown in FIG. 4. This arrangement permits two cigarettes in each test chute 28 to drop downwardly until they abut against the support webs 39 which are unchanged when compared with FIG. 6.

The present arrangement of the device is adapted to two groups for examination of the cigarettes 11 and for the passage thereof through the testing unit 17. The test plane 34 is disposed above the delivery plane 19 at a distance therefrom—such spacing corresponding to the diameter of two cigarettes. Consequently, the tested cigarettes only enter the region of the delivery and discharge means 35 after two feed cycles.

Figure 2:
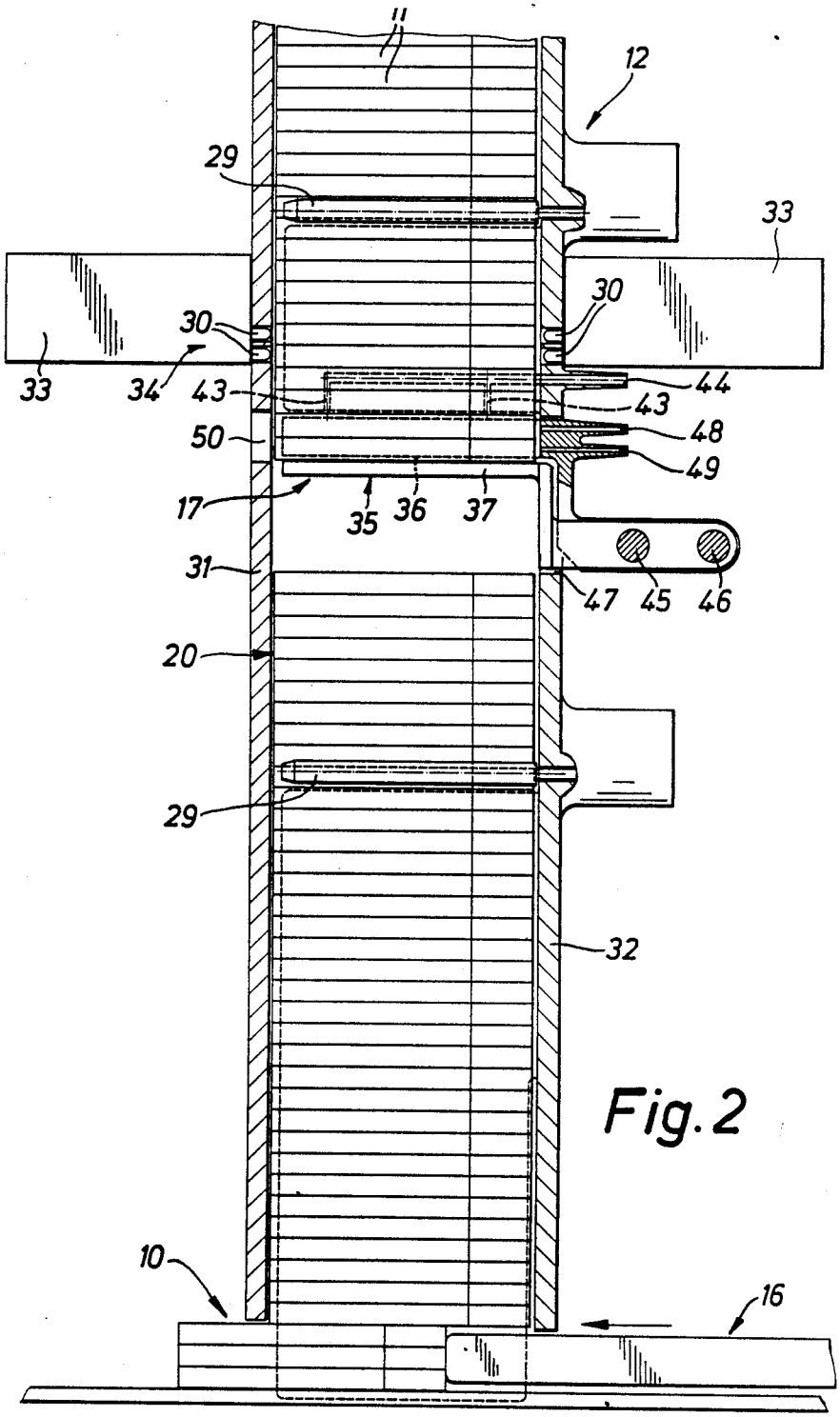
FIG. 2 is a vertical sectional view, offset by 90°, through the cigarette magazine of FIG. 1 in the region of a test chute and a magazine chute.
Figure 3:
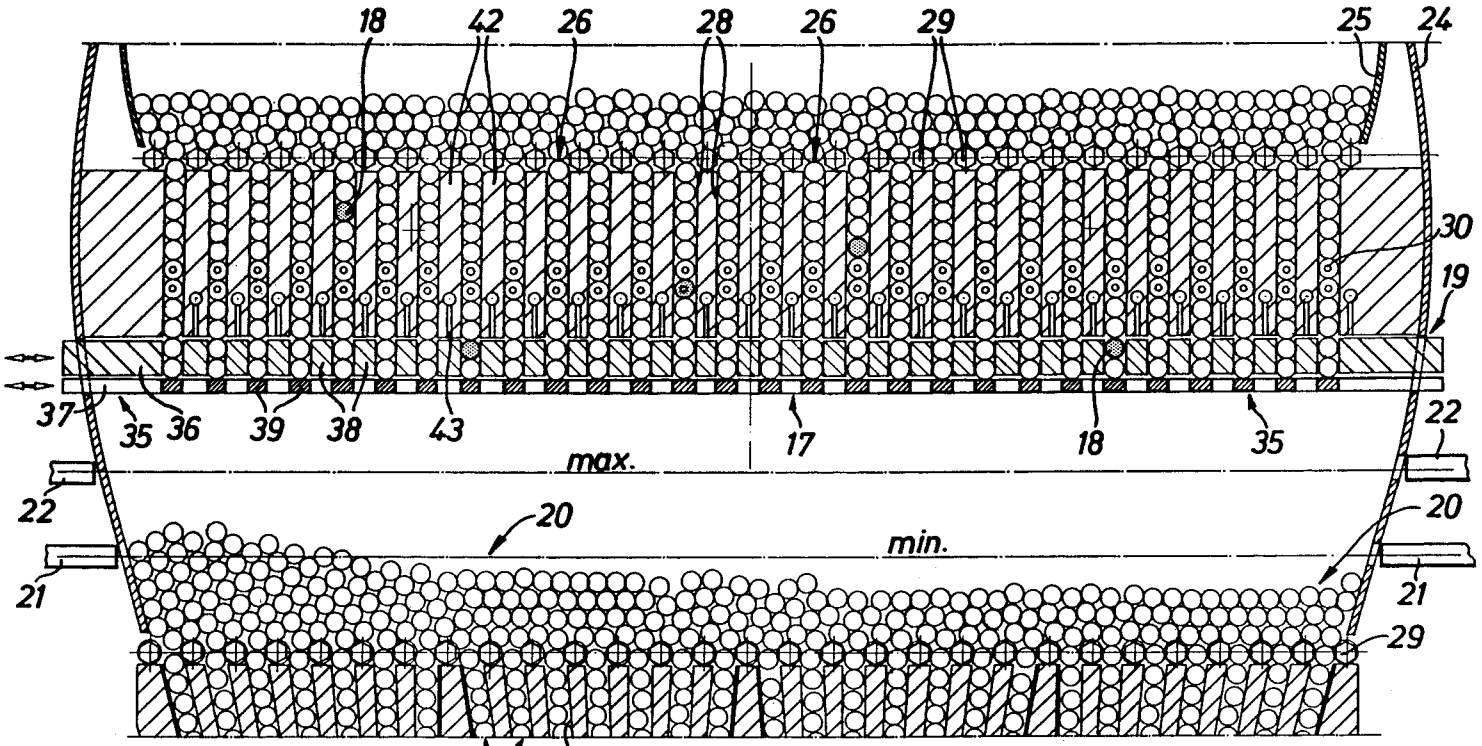
FIG. 3 is an enlarged detail of the cigarette magazine shown in FIG. 1.

As illustrated in FIG. 2, the guide and support means 36 and 37, which are displaceable relative to each other, are displaceably mounted and supported on two parallel supporting rods 45 and 46 externally of the cigarette magazine 12 adjacent to the lateral wall 32. In this region, the lateral wall 32 is provided with an opening 47 for the guide and support means 36 and 37 to pass therethrough.

The defective cigarettes 18 in the region of the guide and support means 36 may be discharged by various methods. In the present case, two ejector nozzles 48 and 49 are provided one above the other in the lateral wall 32 of the cigarette magazine 12, each nozzle being disposed at the same height and position as the tested cigarettes between the cog webs 38. A discharge aperture 50 is provided in the lateral wall 31 on the opposite side.

I claim:

1. A cigarette magazine (12) comprising:

a plurality of vertical magazine chutes (13) for vertically conveying a plurality of vertical columns (14) of horizontally disposed, elongated cigarettes whose longitudinal dimensions lie in a horizontal plane, and for forming and discharging groups of the cigarettes; and a testing unit means (17) integral with said magazine and located vertically above said magazine chutes (13) and extending horizontally through the cigarette magazine (12) for detecting and separating out defective from non-defective cigarettes;

wherein said testing unit means (17) comprises:

for the purpose of accommodating a plurality of vertical test columns (26) of cigarettes (11), a plurality of respective vertical, straight-walled, parallel test chutes (28) which are defined by a plurality of parallel, horizontally spaced, vertical dividing walls (42) and which correspond in number to the number of said magazine chutes (13);

at least two testing means (30), associated with each test chute (28), for simultaneously testing two cigarettes (11), disposed one on top of another, in each test chute;

cigarette delivery and discharge means (35) located underneath said test chutes (28) in a region in which tested defective cigarettes are ejected from the magazine in the direction of their longitudinal dimension and in which tested, non-defective cigarettes are released downwards inside the magazine (12), said cigarette delivery and discharge means (35) comprising only first and second movable guiding and supporting cog plate means (36 and 37) which are disposed in, and are movable relative to one another and relative to said test chutes (28) in, respective vertically spaced horizontal planes so that said first cog plate means (36) is above said second cog plate means (37);

said first cog plate means (36) being disposed immediately underneath said test chutes (28) and having vertically extending cog webs (38) with the same horizontal spacing as that of said dividing walls (42); said cog webs (38) havin a test position in which said cog webs (38) are vertically aligned with said test chutes (28) for supporting respective said test columns (26) and retaining two previously received and tested cigarettes between adjacent cog webs (38) during testing of the cigarettes in said test chutes (28); and said cog webs (38) having an initial position in which said cog webs (38) are vertically aligned with said dividing walls (42) for receiving said two previously tested cigarettes at a time between adjacent cog webs (38);

said second cog plate means (37) having support webs (39), with the same horizontal spacing as said cog webs (38), disposed in vertical alignment with said dividing walls (42) in said test position for supporting each two cigarettes received between adjacent cog webs (38), said support webs (39) being disposed in a delivery position in vertical alignment with said test chutes (28) and said cog webs (38);

means (46) for horizontally shifting said second cog plate means (37) one half the distance of said horizontal spacing from said test position to said delivery position, while said first cog plate means (36) is in said test position and after the ejection of defective cigarettes, so that tested non-defective cigarettes are vertically discharged through said cog webs (38) and said support webs (39), said cog webs (38) being vertically dimensioned to accommodate two cigarettes simultaneously tested in each test chute (28) by said testing means (30);

means (45) for horizontally shifting, while said second cog plate means (37) is in said delivery position and after vertical discharge of the non-defective cigarettes, said first cog plate means (36) from said test position to said initial position to receive previously tested cigarettes which are retained between adjacent cog webs (38) and which are supported by said support webs (39); and means (45, 46) for horizontally shifting said first (36) and said second (37) cog plate means to said test position.

2. A cigarette magazine according to claim 1, comprising a chuteless cigarette store (20) located below said testing unit means (17) and on top of the magazine chutes (13), such that an upper level of discharged cigarettes in the store is vertically spaced apart from the testing unit means (17).

3. A cigarette magazine according to claim 2, wherein the testing unit means (17) is disposed in a region of a maximum horizontal dimension of a housing (24) which encloses the cigarette magazine (12) and which converges downwardly to the magazine chute (13).

4. A cigarette magazine according to claim 1, comprising nozzle means (43) in the walls (42) of said test chutes (28), for directing compressed air downwardly against the tested non-defective cigarettes which are in said delivery position.

5. A cigarette magazine according to claim 4, comprising ejector means (48 and 49) for directing compressed air horizontally against defective cigarettes located between said cog webs (38) in said test position and for ejecting from said magazine the defective cigarettes in a direction coinciding with the longitudinal dimension of a cigarette.

* * * * *